US006001423A

United States Patent [19]

Johnson

[11] Patent Number: 6,001,423

[45] Date of Patent: Dec. 14, 1999

[54] METHOD OF LEAD PAINT ENCAPSULATION

[76] Inventor: Roy Johnson, 3439 W. Brainard Rd., #260, Woodmere, Ohio 44122

[21] Appl. No.: 08/160,447

[22] Filed: Dec. 1, 1993

Related U.S. Application Data

[63] Continuation of application No. 07/991,701, Dec. 17, 1992, abandoned, which is a continuation of application No. 07/522,550, May 14, 1990, abandoned.

[51] Int. Cl.[6] ..... B05D 1/36

[52] U.S. Cl. ..... 427/403; 427/140; 156/71; 156/94; 264/333; 442/42

[58] Field of Search ..... 428/245, 247; 427/140, 403; 442/42; 264/333; 156/71, 94

[56] References Cited

U.S. PATENT DOCUMENTS

| | | | |
|---|---|---|---|
| 4,349,398 | 9/1982 | Kearns et al. | 156/71 |
| 4,430,463 | 2/1984 | Mullenax | 524/5 |
| 4,791,159 | 12/1988 | Dulaney et al. | 524/297 |

*Primary Examiner*—Christopher Raimund
*Attorney, Agent, or Firm*—Calfee, Halter & Griswold, LLP

[57] ABSTRACT

The invention relates to a method for encapsulating lead paint on a surface comprises the steps of applying a glass mesh to the surface containing the lead paint and applying an encapsulating mixture in a continuous layer over the glass mesh and to the encapsulated lead paint surface. The invention completely seals and encapsulates the lead paint and has significant structural integrity to prevent exposure to lead paint.

16 Claims, 2 Drawing Sheets

METHOD OF LEAD PAINT ENCAPSULATION

This is a continuation of Ser. No. 07/991,701 filed on Dec. 17, 1992, now abandoned, which is a continuation of Ser. No. 07/522,550, filed on May 14, 1990, now abandoned.

BACKGROUND OF THE INVENTION

Exposure to lead from lead paint can lead to lead poisoning, especially in children. Numerous cases of lead poisoning in children from ingestion of lead paint have been documented.

Lead paint is frequently found in older buildings, and most often in public housing. Because of the potential of exposure to lead paint to cause lead poisoning in children and others, lead paint must either be removed or encapsulated. Removal of lead paint has been accomplished by sand blasting or other abrasive techniques. Such abrasive techniques run the risk of exposure to air borne particulates of lead paint. Encapsulating techniques avoid this potential exposure to lead paint particulates. Existing encapsulation methods are deficient in that they lack structural integrity and can crack, thereby exposing inhabitants to the underlying lead paint, or require the successive application of several layers of encapsulating material. The present invention overcomes these structural deficiencies, and imparts to the encapsulating surface a high degree of structural integrity sufficient to withstand the ordinary wear and tear to which the surfaces are subjected, while providing an increased efficiency in the encapsulation because the encapsulating layer is applied as one continuous layer.

SUMMARY OF THE INVENTION

The present invention relates to a method for encapsulating lead paint on a surface and to a surface with a continuous encapsulated layer of lead paint thereon. In one embodiment of the method of the invention, the method comprises the steps of applying a glass mesh to the surface and coating the glass mesh with an encapsulating mixture comprised of silica sand, hydrated calcium oxide, portland cement, titanium dioxide and an aqueous acrylic emulsion, in one continuous layer. Another embodiment comprises coating the surface with the encapsulating mixture, applying the glass mesh and continuing to apply the encapsulating mixture to form a continuous layer of encapsulating material in which the glass mesh is embedded. In another embodiment of the invention, the method comprises the steps of coating the surface with a pigmented paint, and applying the encapsulating mixture in one continuous layer over the pigmented paint.

An encapsulated surface formed according to the invention comprises a layer of lead paint, a glass mesh, and a continuous layer of encapsulating mixture substantially filling the interstices of the glass mesh and extending outward therefrom to form the outer surface of the encapsulated lead paint surface.

It is an object of the present invention to provide a method for encapsulating lead paint on a surface with a continuous encapsulating layer.

It is a further object of the present invention to provide an encapsulating surface with a high degree of structural integrity sufficient to withstand ordinary wear and tear.

It is a further object of the present invention to provide an encapsulating surface which provides a smooth exterior requiring no additional work before habitation.

It is an additional object of the present invention to provide an encapsulating surface adaptable to an array of colors thereby eliminating any need to paint the encapsulating surface.

DETAILED DESCRIPTION OF THE INVENTION

Figure 1A:
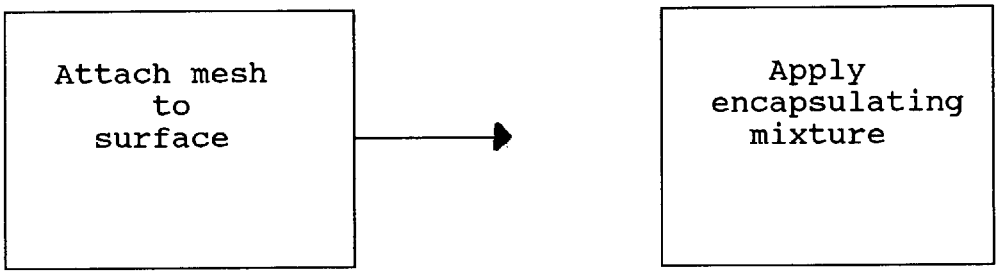
FIG. 1*a* and 1*b* represent the steps involved in alternative methods for encapsulating a lead paint surface according to the present invention.

The present invention relates to a method for encapsulating lead paint on a surface and to an encapsulated surface. The method, in one embodiment as shown in FIG. 1*a*, comprises the steps of applying a glass mesh to the surface containing lead paint and applying a continuous layer of encapsulating mixture over the glass mesh. The glass mesh is a finely woven symmetrical interlace. Although many types of glass mesh may be used in the practice of the present invention, the preferred glass mesh has a thread count per inch of warp thread of ten plus or minus one filling thread, and a thread thickness of 0.008 inches. Preferably the glass mesh is made from filaments of smooth physical, noncellular glass filament which promotes stability and durability. The glass mesh must be an open mesh so as to allow complete penetration of the encapsulating mixture. The glass mesh may have a self adhesive backing. In such a case, the glass mesh is placed onto the surface to be encapsulated and held in place by its adhesive. Alternatively, the glass mesh may be mechanically fastened to the surface.

A continuous layer of the encapsulating mixture is applied over the glass mesh. The encapsulating mixture is comprised of the following, based upon 100 parts by weight of the total encapsulating mixture:

1. 45 to 60 parts by weight of silica sand comprised of silica sand particles having the following particle size distribution based upon 100 parts:
   a. 9.3 parts silica sand which is retained on a 40 mesh screen;
   b. 23.3 parts silica sand which is retained on a 50 mesh screen;
   c. 34.4 parts silica sand which is retained on a 70 mesh screen;
   d. 21.3 parts silica sand which is retained on a 100 mesh screen;
   e. 11.7 part silica sand which is retained on a 270 mesh screen.
2. 3–10 parts by weight of hydrated calcium oxide;
3. 20–30 parts by weight portland cement;
4. 10–15 parts by weight of Rhoplex aqueous acrylic emulsion;
5. 1–5 parts by weight of titanium dioxide;
6. with the balance water to 100 parts total mixture.

The particle size distribution of the silica sand is determined by the use of mesh screens meeting the standards set forth in ASTM-C-136-E-11. The hydrated calcium oxide preferably meets the standards set forth in ASTM C-206, Type S. The portland cement preferably meets the standards set forth in ASTM C-150-85A.

The RHOPLEX brand acqueous acrylic emulsion is available from Rohm and Haas. The acqueous acrylic emulsion is an acrylic emulsion which provides. Acqueous acrylic emulsions from other suppliers besides Rohm and Haas may also be employed in the present invention. The acqueous acrylic emulsion of the present invention should provide an encapsulating mixture which is resistant to water, resistant to ultraviolet light and heat, and which is vapor permeable.

In addition to the above, an effective amount of a defoamer may be added. The preferred defoamer is a non-ionic surfactant in the form of an alkyl phenoxy polyethoxy-alkanol such as nonyl phenoxy polyethoxyethanol.

Additionally, the encapsulating mixture may be comprised of a coloring additive in an amount sufficient to impact the desired color. Any coloring additive which does not materially effect the adhesive properties or structural integrity of the encapsulating mixture may be employed. Examples of coloring additives which may be employed in the present invention include synthetic mineral oxides such as Bay-Ferrox available from Mobay Chemical Corporation.

The encapsulating mixture may be further comprised of effective amounts of bactericides, fungicides or mold inhibitors. Any bactericide, fungicide or mold inhibitor which does not effect the adhesive properties or the structural integrity of the encapsulating mixture may be employed in the present invention. For example bactericides, fungicides and mold inhibitors such as Super-Ad-It available from Rohm and Haas Corporation may be employed in the present invention.

Figure 1B:
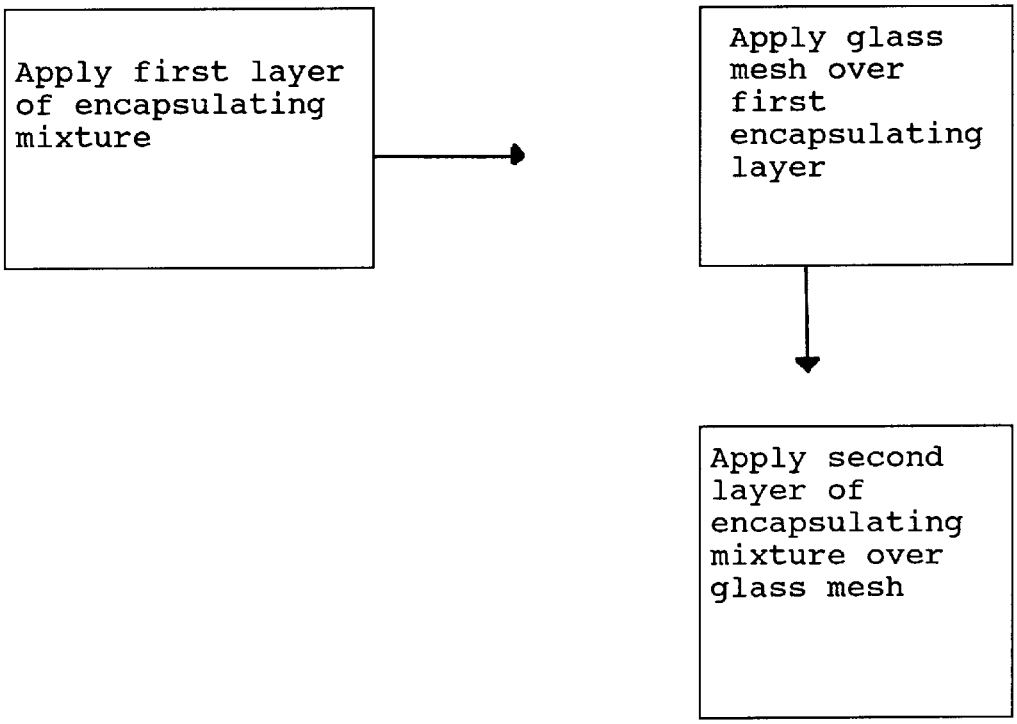

In another embodiment of the invention, the method comprises the steps of applying a first layer of the encapsulating mixture to the surface, applying the glass mesh over the first layer of encapsulating mixture and continuing to apply the encapsulating mixture over the glass mesh to form a continuous layer of encapsulating mixture in which the glass mesh has been embedded. This embodiment is shown in FIG. 1*b*. This embodiment eliminates the need to fasten the glass mesh to the surface by an adhesive or mechanical fastener because the glass mesh is held in place by the encapsulating mixture.

Where the structural integrity of a surface is less important because the surface in unlikely to be disturbed by the inhabitants of a structure, for example, on a ceiling surface, the encapsulating mixture may be applied over a layer of pigmented paint. On surfaces such as ceilings, the glass mesh may be eliminated because the additional structural integrity it provides to the encapsulated surface may not be needed. Where this embodiment of the present invention may be employed, the surface is first coated with a pigmented paint, which is allowed to completely dry. Then the encapsulating mixture is applied directly over the surface coated with the pigmented paint.

Figure 2:
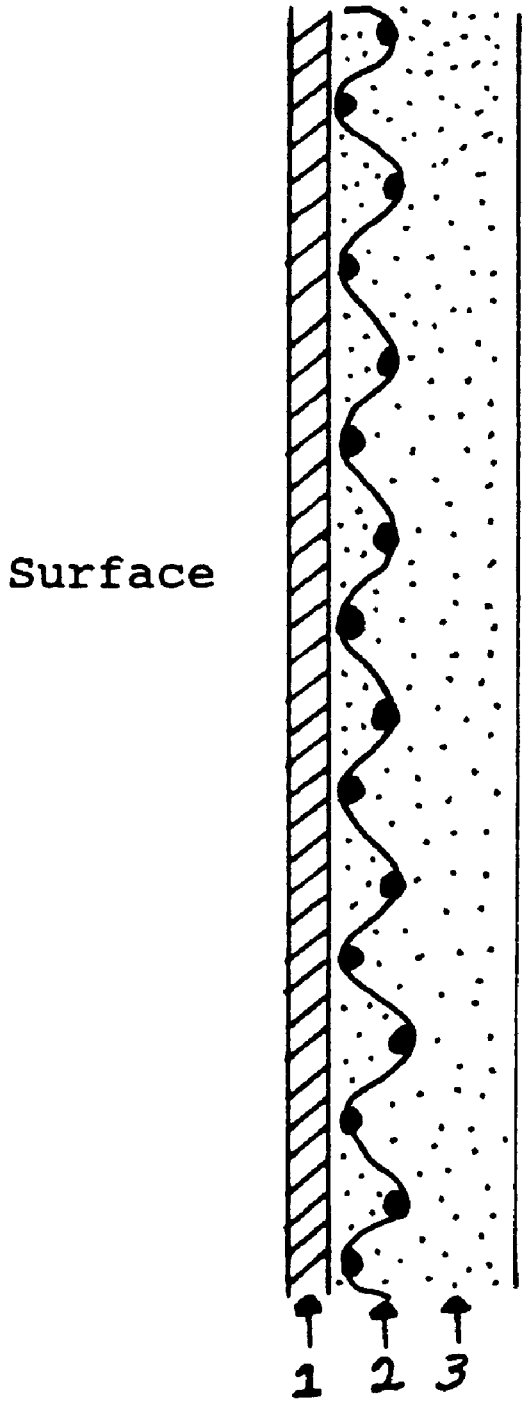
FIG. 2 represents a cross sectional view of an encapsulated lead paint surface formed according to the invention.

An encapsulated surface formed according to the invention, shown in FIG. 2, comprises a layer of lead paint, 1, a glass mesh, 2, and a continuous layer of encapsulating mixture, 3, substantially filling the interstices of the glass mesh and extending outward therefrom to form the outer surface of the encapsulated lead paint surface. The encapsulating mixture is thus adjacent to the lead paint in the interstices of the glass mesh.

The encapsulating mixture may be applied by hand by trowel or other appropriate means or by spraying onto the surface or by any other appropriate mechanical method. When the encapsulating mixture begins to set, texture may be developed on the surface by running a sponge over the encapsulating material.

In order to insure that all lead paint containing surfaces are made inaccessible to the inhabitants of a dwelling, the door frames, window sills and frames and other lead paint containing trim may be covered with preformed plastic caps. These preformed plastic caps may be shaped so as to tightly fit over such sills, frames and trim. Alternatively, the plastic caps may be fixed to the sills, frames and trim by any other method, such as nails, screws or a suitable adhesive.

Obviously, many variations of the present invention will be apparent to those skilled in the art in light of the above detailed description, all such obvious variations are within the full intended scope of the following claims.

What I claim is:

1. A method for encapsulating lead paint carried on a surface comprising covering the lead paint on said surface with a continuous layer of an encapsulating mixture comprising silica sand, hydrated calcium oxide, Portland cement, titanium dioxide and an aqueous acrylic emulsion, and thereafter allowing said encapsulating mixture to set thereby making the lead paint on said surface inaccessible.

2. A method for encapsulating lead paint according to claim 1 wherein said encapsulating mixture is further comprised of a colored additive in sufficient quantity to give the encapsulating mixture a desired color.

3. A method for encapsulating lead paint on a surface according to claim 1 wherein said encapsulating mixture is applied by trowel.

4. A method for encapsulating lead paint on a surface according to claim 1 wherein said encapsulating mixture is sprayed onto the surface.

5. A method for encapsulating lead paint on a surface according to claim 1 wherein the encapsulating mixture is further comprised of an effective amount of a bactericide.

6. A method for encapsulating lead paint on a surface according to claim 1 wherein the encapsulating mixture is further comprised of an effective amount of a mold inhibitor.

7. The method of claim 1 further comprising embedding in said layer before setting thereof a glass mesh in such a way that said encapsulating mixture substantially fills the intersities of said glass mesh.

8. The method of claim 7 wherein said glass mesh has a thread count of 10±1 threads per inch and a thread thickness of about 0.008 inch.

9. The method of claim 8 wherein said glass mesh is made from smooth, non-cellular glass filaments.

10. The method of claim 7 wherein said method comprises (a) applying a glass mesh to the surface containing lead paint (b) applying a continuous layer of encapsulating mixture over the glass mesh.

11. The method of claim 1 wherein said method comprises:

(a) applying a glass mesh to the surface containing lead paint (b) applying a continuous layer of encapsulating mixture over the glass mesh.

12. The method of claim 1 wherein surfaces carrying lead paint inside a dwelling are subjected to encapsulation and further wherein such lead paint carrying surfaces are part of the dwelling.

13. The method of claim 12 wherein said surfaces comprise walls of said dwelling.

14. A method for encapsulating lead paint on a surface according to claim 12 further comprising the steps of:

a) covering the door frames, window sills and frames and other trim with preformed plastic caps.

15. The method of claim 1 wherein a glass mesh is applied to said surface and thereafter a continuous layer of encapsulating mixture is applied over said glass mesh.

16. The method of claim 1 wherein said mixture comprises:

(1) 45 to 60 parts by weight of silica sand comprised of silica sand particles having the following particular size distribution based upon 100 parts:

f. 9.3 parts silica sand which is retained on a 40 mesh screen;

g. 23.3 parts silica sand which is retained on a 50 mesh screen;

h. 34.4 parts silica sand which is retained on a 70 mesh screen;

i. 21.3 parts silica sand which is retained on a 100 mesh screen;

j. 11.7 parts silica sand which is retained on a 270 mesh screen;

(2) 3–10 parts by weight of hydrated calcium oxide;

(3) 20–30 parts by weight portland cement;

(4) 10–15 parts by weight of Rhoplex aqueous acrylic emulsion;

(5) 1–5 parts by weight of titanium dioxide;

(6) with the balance being water to 100 parts total mixture.

* * * * *